US006293367B1

(12) United States Patent
Gulseth

(10) Patent No.: US 6,293,367 B1
(45) Date of Patent: Sep. 25, 2001

(54) LADDER LEVELING APPARATUS

(76) Inventor: Hilmar K. Gulseth, 18 Pleasant St., Proctor, VT (US) 05765

( * ) Notice: Subject to any disclaimer, the term of this patent is extended or adjusted under 35 U.S.C. 154(b) by 0 days.

(21) Appl. No.: 09/550,722

(22) Filed: Apr. 17, 2000

(51) Int. Cl.[7] ..... E06C 1/00; E06C 7/00
(52) U.S. Cl. ..... 182/204; 182/200; 248/188.2
(58) Field of Search ..... 182/204, 200, 182/201, 166, 205; 248/188.2, 188.3

(56) References Cited

U.S. PATENT DOCUMENTS

| | | | | |
|---|---|---|---|---|
| 388,076 | | 8/1888 | Schmidt . | |
| 810,170 | | 1/1906 | Potter . | |
| 970,425 | | 9/1910 | Curran . | |
| 1,033,685 | | 7/1912 | Eskew . | |
| 1,197,727 | | 9/1916 | Fink . | |
| 1,330,956 | | 2/1920 | Schulze . | |
| 1,376,777 | * | 5/1921 | O'Connor | 182/205 |
| 1,499,300 | * | 6/1924 | Hayes | 182/205 |
| 1,651,863 | * | 12/1927 | Baur | 182/200 |
| 2,127,884 | | 8/1938 | Overpeck . | |
| 2,147,052 | * | 2/1939 | Noone | 182/205 |
| 2,405,269 | * | 8/1946 | Prutsman | 182/205 |
| 2,468,856 | * | 5/1949 | Alexander | 248/188.2 X |
| 2,567,806 | | 9/1951 | Doss . | |
| 3,908,796 | * | 9/1975 | Hurwitz | 182/201 |
| 5,476,153 | * | 12/1995 | Dickerson et al. | 182/204 |

FOREIGN PATENT DOCUMENTS

| | | | | |
|---|---|---|---|---|
| 219043 | * | 8/1958 | (AU) | 182/204 |
| 247983 | * | 3/1963 | (AU) | 182/204 |

* cited by examiner

*Primary Examiner*—Daniel P. Stodola
*Assistant Examiner*—Hugh B. Thompson
(74) *Attorney, Agent, or Firm*—John J. Welch Jr., Esq.

(57) ABSTRACT

An extension ladder with ladder leveling apparatus consisting of an extension ladder, an elongated stabilizing strut with a series of teeth extending laterally therefrom and attachable to one leg of the extension ladder unit by way of a pair of u-bolt components each with a pair of threaded ends with such threaded ends being insertable one each through each of two through holes in each of a pair of grip components with teeth extending medially from one side of each grip component to complement and insert within spacing between the teeth of the stabilizing strut upon the tightening of threaded nuts one each about each threaded end of each dual bolt component and further with the stabilizing strut terminating in a footing component that extends laterally from the lie of the plane of said strut and which footing component is flared outwardly both anteriorly and posteriorly and to which an anteroposteriorly pivotable foot unit equipped with a rubberize base pod is attached.

2 Claims, 8 Drawing Sheets

LADDER LEVELING APPARATUS

REFERENCES TO PRIOR OR PARENT APPLICATIONS

Figure 1:
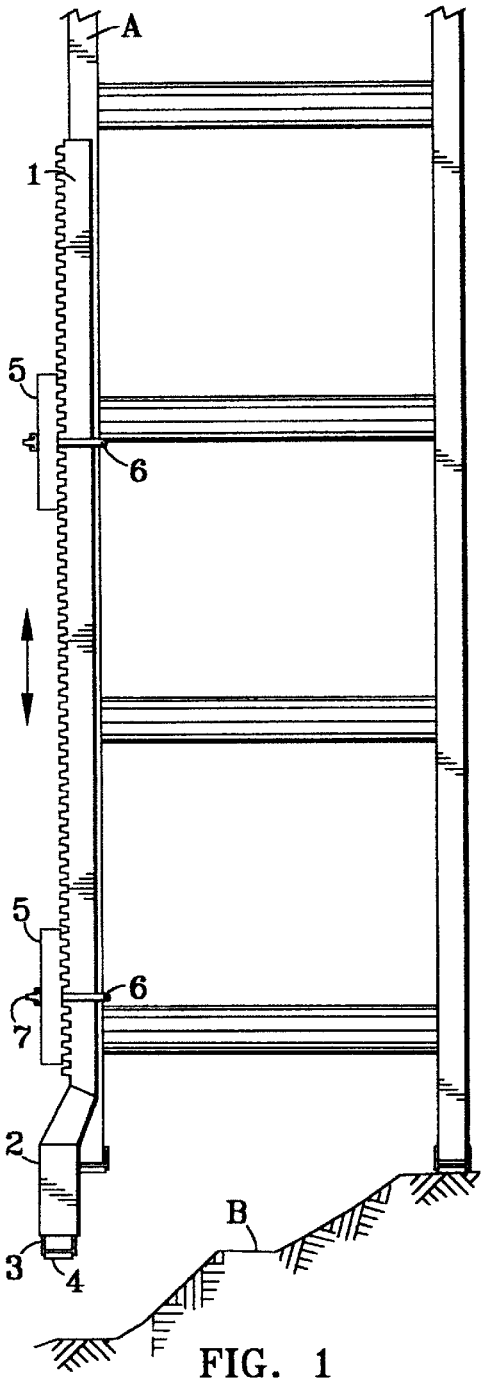

There are no prior or parent applications to which the instant application relates.

FEDERALLY SPONSORED RESEARCH AND DEVELOPMENT

There is no federally sponsored research and development to which the instant application relates.

BACKGROUND OF THE INVENTION

1. Field of the Invention

The instant invention relates to those devices serving to facilitate ladder leveling on hilly terrain.

2. Related Art

The contemporaneously filed Informational Statement refers to art which however does not anticipate the instant invention.

A SUMMARY OF THE INVENTION

1. A Brief Description of the Invention

The instant invention is an extension ladder with ladder leveling apparatus consisting of an elongated stabilizing strut affixed to one leg of the extension ladder with a laterally extending footing component affixed to the base of the strut. The footing component flares outwardly both anteriorly and posteriorly in order to allow for space affordable to the base of one side of a ladder unit to thereby render it amenable to positioning anywhere at or above the lowest point of laterally sloping ground below the location of the ladder unit A pivotable foot unit is affixed to the footing component and is itself equipped with a base stabilizing pod. The strut is characterized by the presence of evenly spaced laterally extending teeth found beginning at about the highest point of the strut and extending down to where the footing component is affixed thereto. A pair of equivalently shaped grip components each with a smooth lateral side have medially extending teeth all amenable to fitting within spacing between the teeth of the strut. Each grip component has a pair of collinear through holes amenable to receipt of the threaded ends of a thresided dual bolt component. A pair of threaded turning nuts are fastened each over a washer unit in respect of each grip component serving to tighten the strut to one side of a ladder unit and to each grip component to thereby provide a modified elongated side of a ladder unit located over laterally sloping ground.

2. Object of the Invention

An object of the invention is to provide a sturdy, economical and easy to assemble means for leveling either side of an extension ladder unit located over laterally sloping ground. Other ladders with leveling devices meant to serve such a function are inherently either not as sturdy or a goodly amount more expensive and/or more complicated to assemble and disassemble from a ladder unit. Moreover, it is imperative that such devices be readily removable from one leg of an extension ladder to the other, since, extension ladders cannot be turned around and utilized in a turned around position as can non-extension ladders. The invention facilitates such leveling over such ground without regards to the manner of lay of sloping regarding use of extension ladders. Respectfully submitted, the feature of the invention smW to permits its ready assembly to either side of a ladder unit concomitant with its sturdiness and economical character as well render it indeed new, useful and unique.

A DESCRIPTION OF THE DRAWINGS

1. FIG. 1 is a frontal plan view of the invention affixed to a ladder unit.

Figure 2:
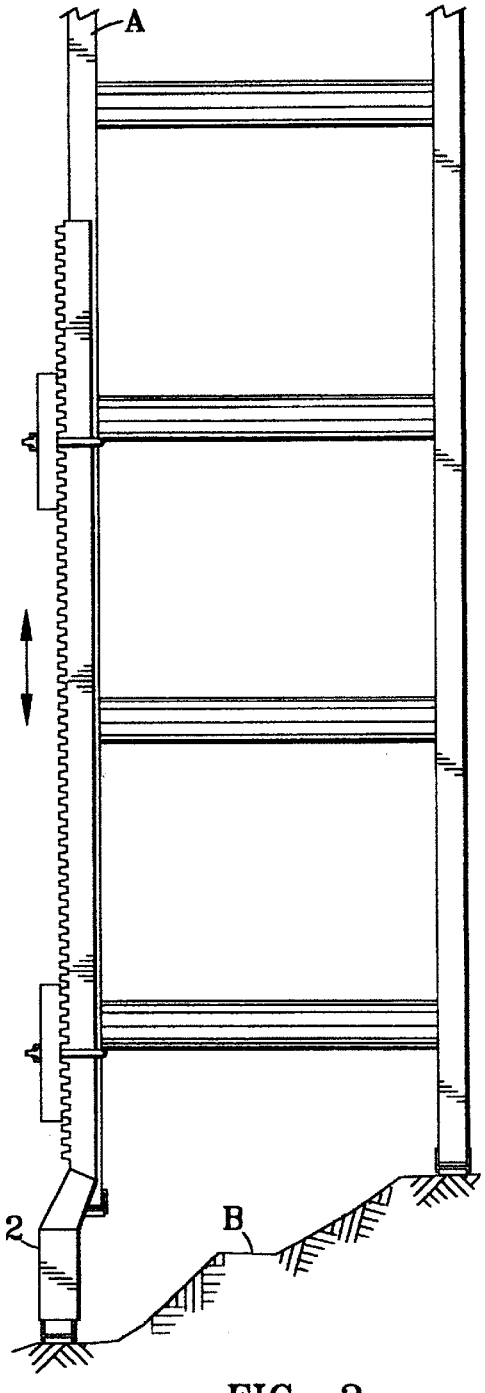

2. FIG. 2 is a frontal plan view of the invention affixed to a ladder unit and stabilizing it on laterally sloping ground.

Figure 3:
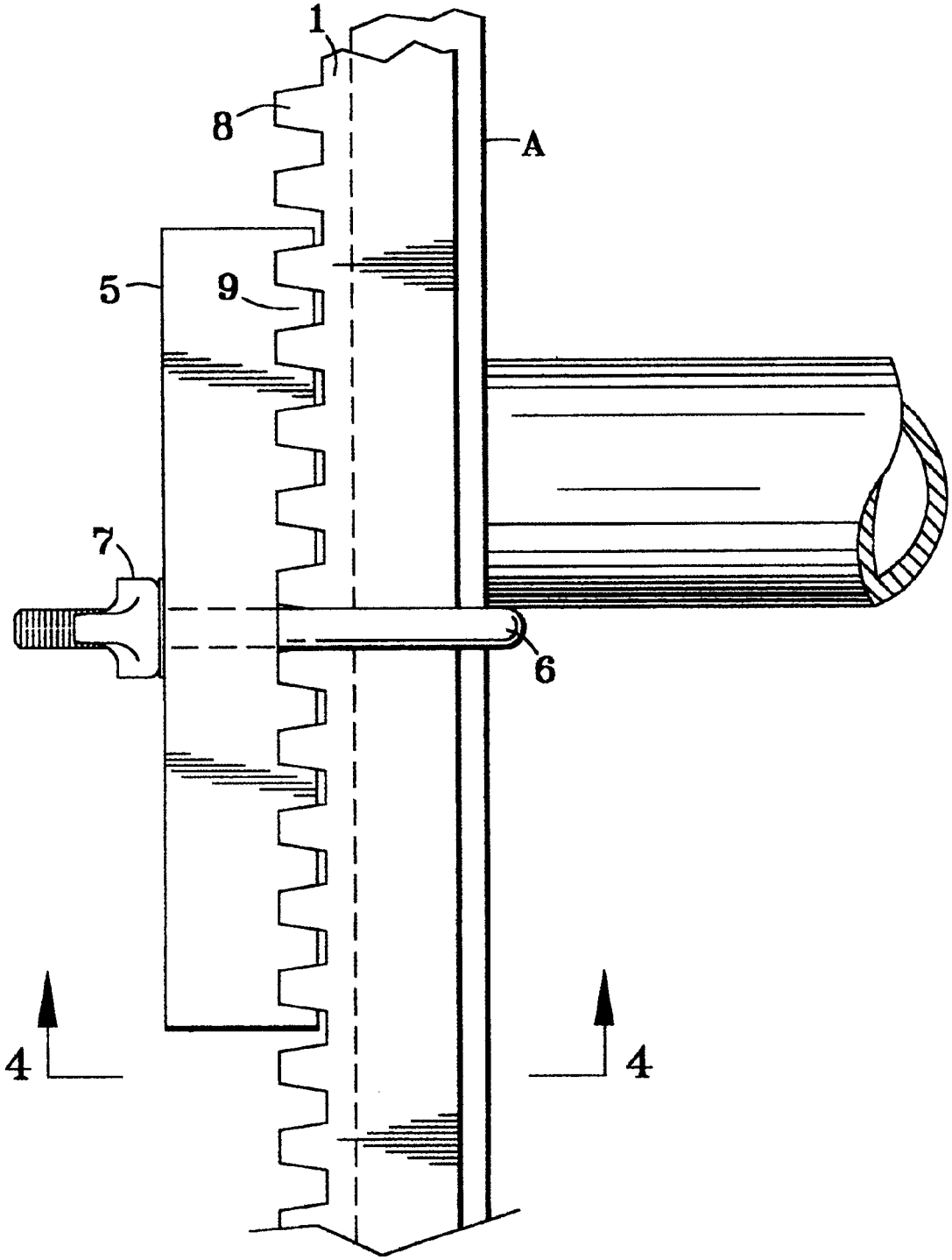

3. FIG. 3 is an isolated frontal plan view of a grip component bolted to a ladder unit via the stabilizing strut of the invention.

Figure 4:
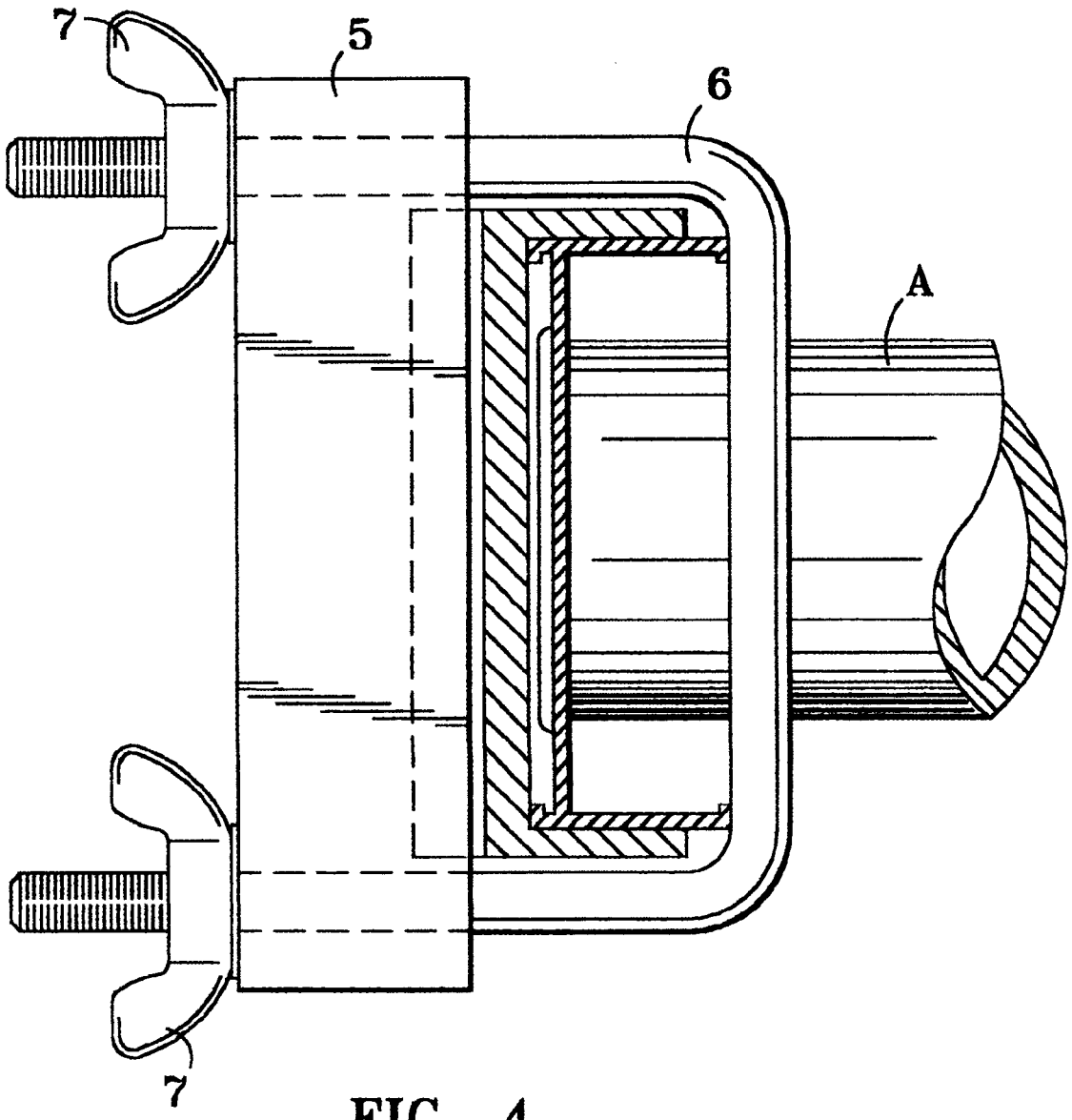

4. FIG. 4 is a bottom plan view of what is shown in FIG. 3.

Figure 5:
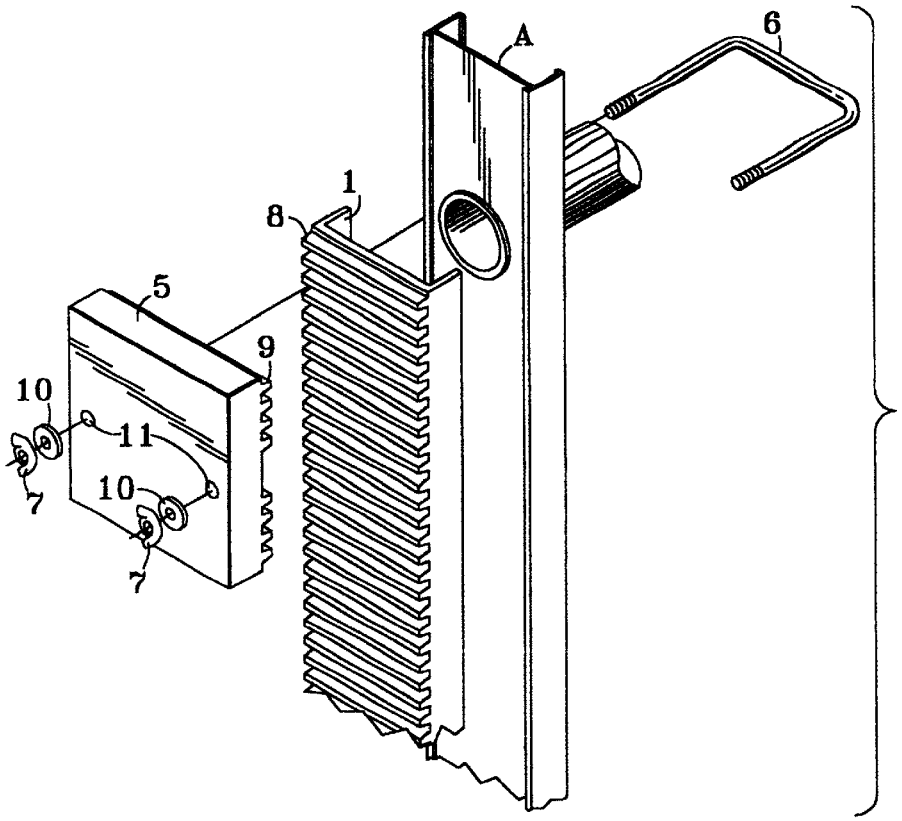

5. FIG. 5 is an isolated exploded view of the essential parts of the invention in apposition to one side of a ladder unit.

Figure 6:
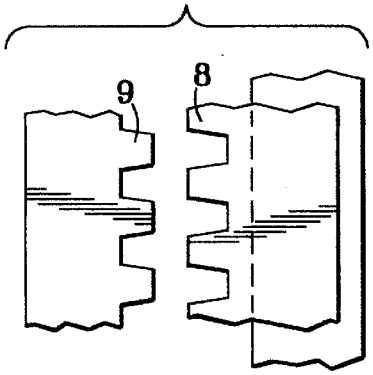

6. FIG. 6 is an isolated view of the teeth of a grip component in apposition to those of the stabilizing strut of the invention.

Figure 7:
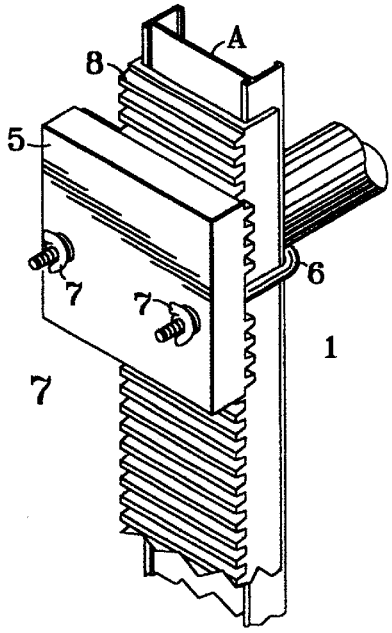

7. FIG. 7 is an isolated perspective view of a portion of the invention assembled to one side of a ladder unit.

Figure 8:
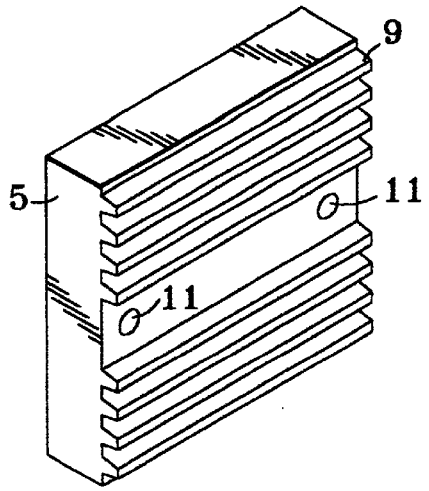

8. FIG. 8 is a perspective view of the medial side of a grip component.

Figure 9:
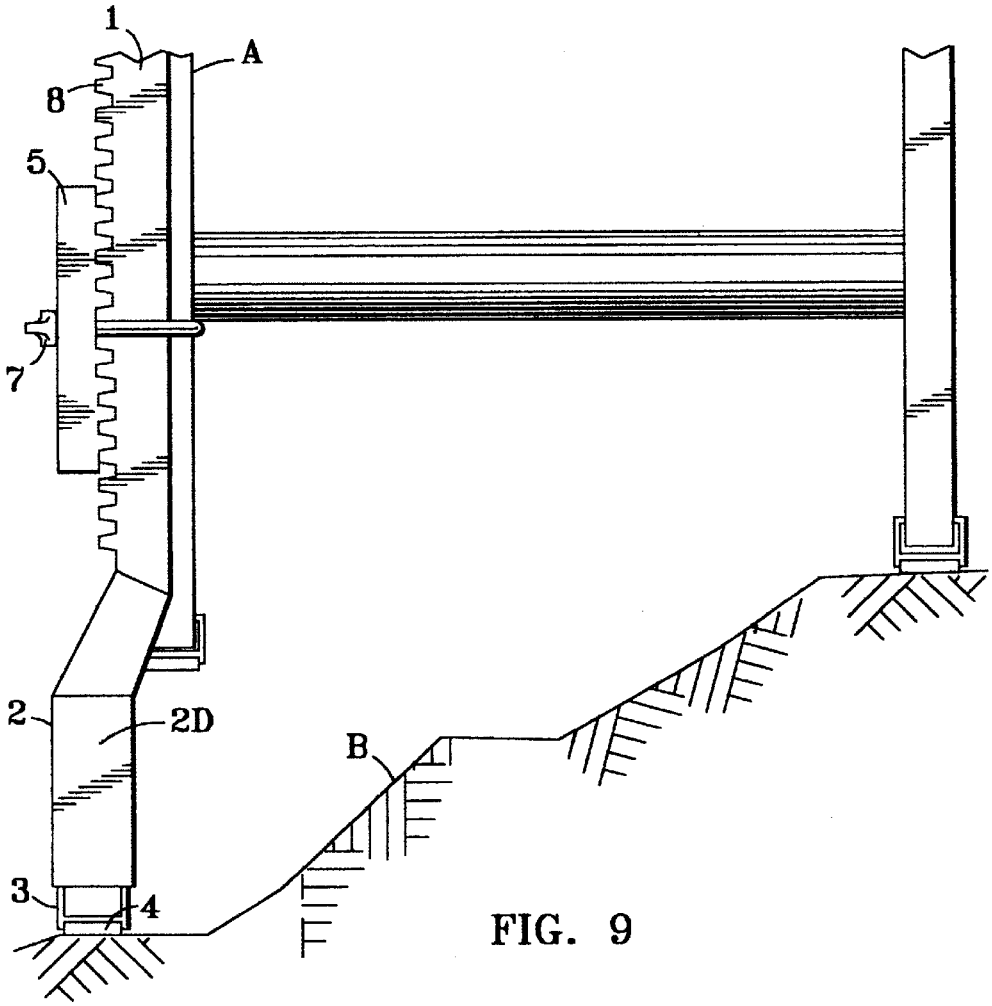

9. FIG. 9 is an isolated frontal plan view of the lowest portion of the invention assembled to one side of a ladder unit and shows stabilization of the ladder unit over laterally sloping ground.

Figure 10:
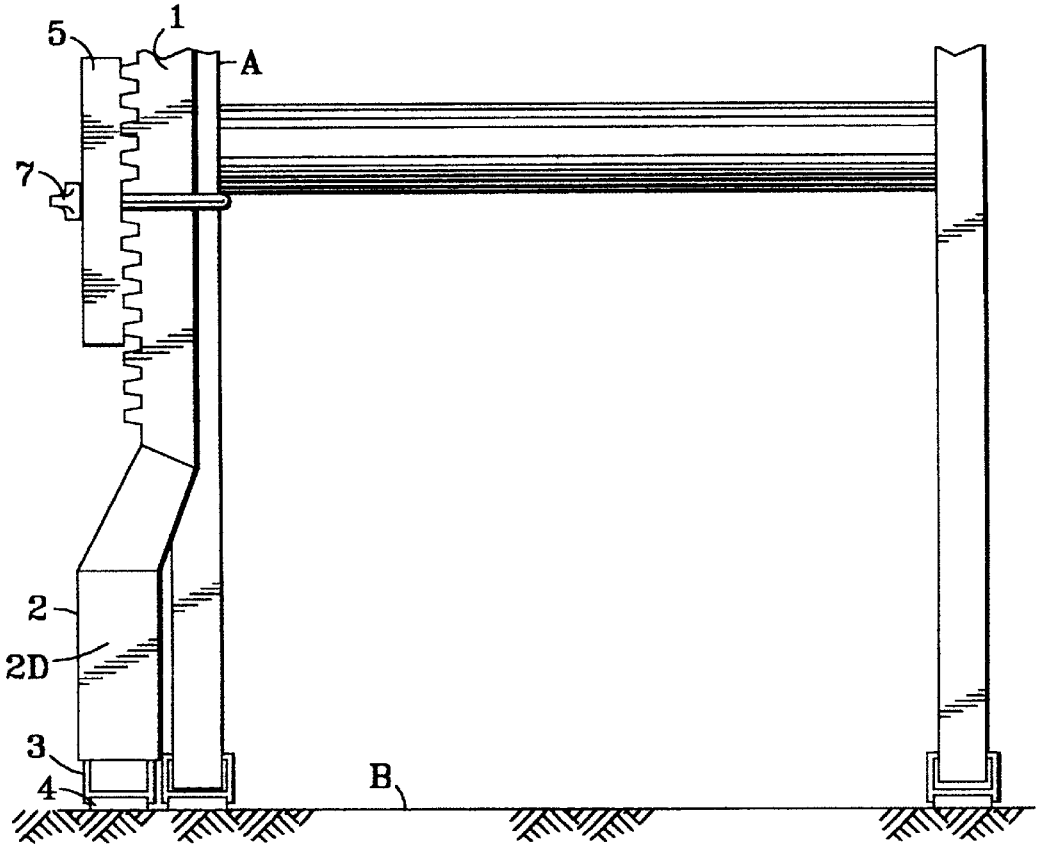

10. FIG. 10 is an isolated frontal plan view of the lowest portion of the invention assembled to one side of a ladder unit located over level ground.

Figure 11:
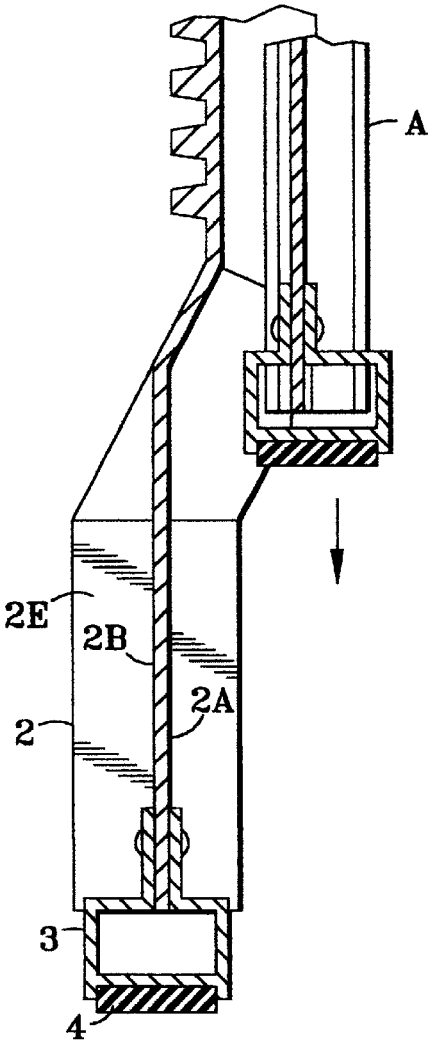

11. FIG. 11 is an isolated cross-sectional view of the footing component of the invention in apposition to the footing of one side of a ladder unit to which the invention would be assembled over laterally sloping ground.

Figure 12:
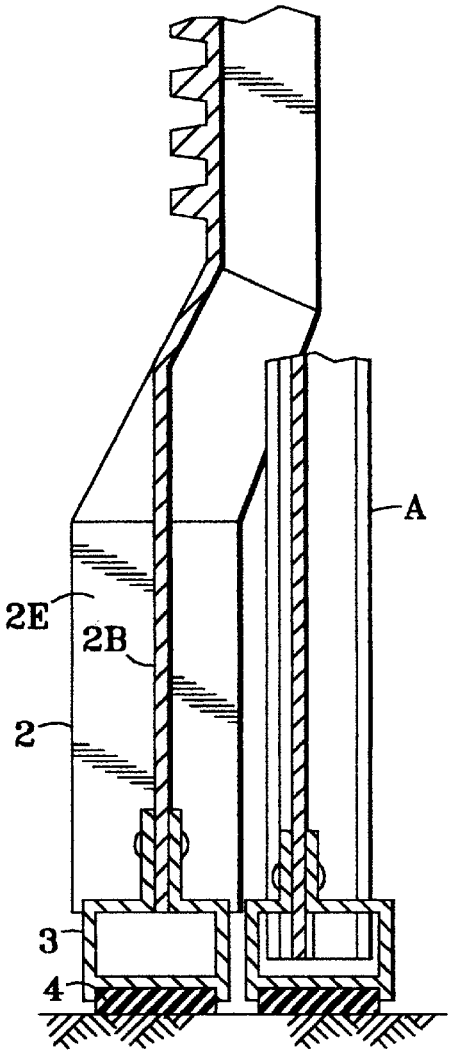

12. FIG. 12 is an isolated cross-sectional view of the footing component of the invention in apposition to the footing of one side of a ladder unit to which the invention is assembled over level ground.

Figure 13:
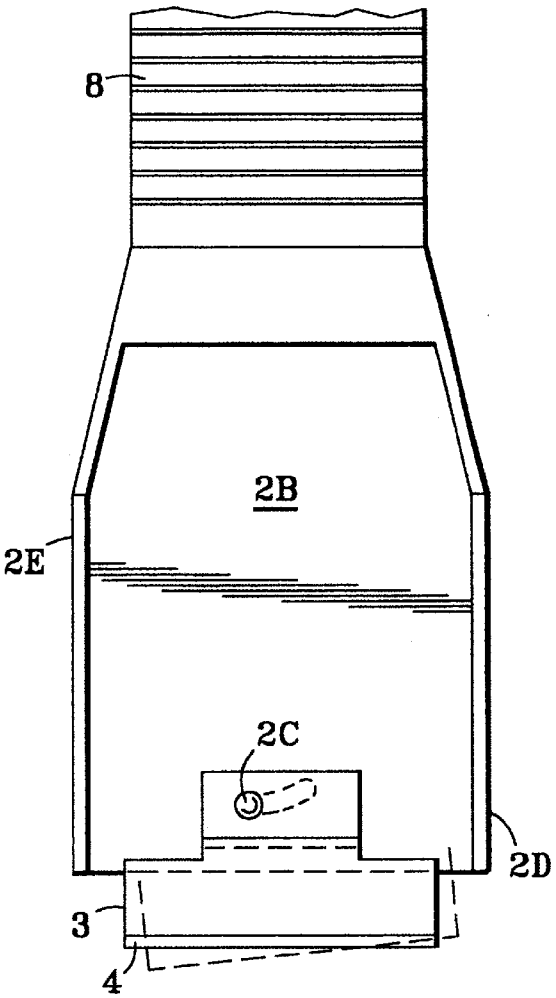

13. FIG. 13 is an isolated lateral plan view of the footing component of the invention.

Figure 14:
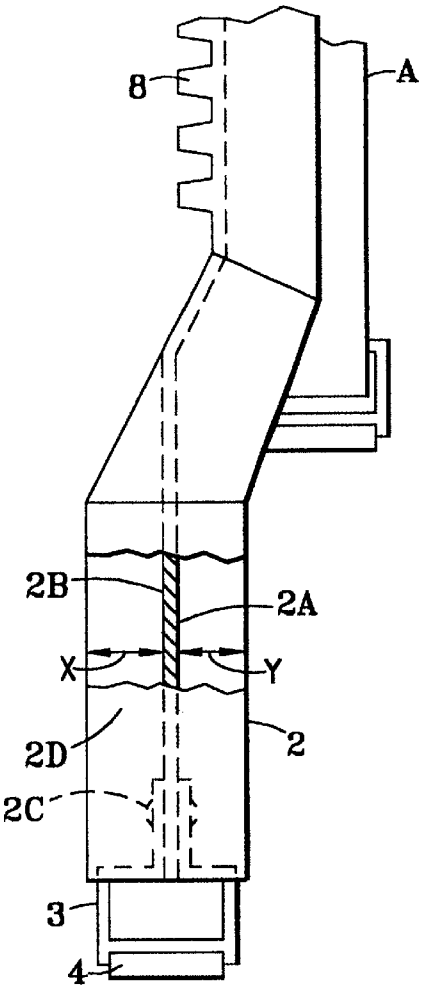

14. FIG. 14 is an isolated frontal view of the footing component of the invention in apposition to one side of a ladder unit.

Figure 15:
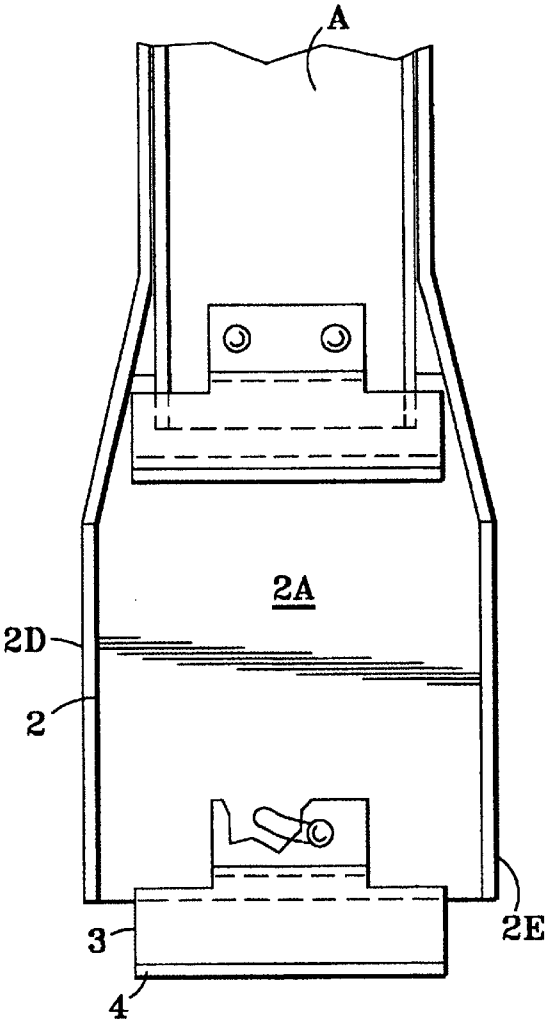

15. FIG. 15 is an isolated medial plan view of the footing component of the invention in apposition to one side of a ladder unit.

A DESCRIPTION OF THE PREFERRED EMBODIMENT

FIGS. 1 and 2 illustrate respectively the manner of assembly of the ladder leveling apparatus to one side of an extension ladder unit A and the manner in which the ladder unit A can then be stabilized to an effectively level position over laterally sloping ground B with resort to the invention affixed thereto. FIGS. 3 and 4 illustrate close up the manner of assembly of the invention to one side of a ladder unit A. FIGS. 5, 6 and 7 depict in even more detail the manner of such assembly. FIG. 9 illustrates the ready functional utility of the invention when affixed to ladder unit A over laterally sloping ground B. FIG. 10 illustrates the manner in which the footing component 2 of the invention can readily accommodate the footing of one side of a ladder unit A to which the invention is affixed. FIGS. 11 and 12 illustrate in more detail that which is shown in FIGS. 9 and 10 respectively. FIGS. 13, 14 and 1,5 demonstrate the antero-posterior flaring outwardly of footing component 2 from the locus of a vertically inclined central axis of symmetry of a stabilizing strut 1 so as to readily accommodate the footing of one side of ladder unit A as seen particularly in FIGS. 10 and 12. Stabilizing strut 1 is elongated as seen in FIGS. 1 and 2. It has laterally extending teeth 9 as therein seen as well. FIGS. 5 and 7 evidence how stabilizing strut 1 which is three-sided is affixed to one side of a ladder unit A. Teeth 8 of stabilizing strut 1 extending lateral therefrom from the top thereof down to where footing component 2 is joined to stabilizing strut 1 as seen in FIGS. 1 and 2 fit into spacing as seen in FIG. 6 as between teeth 9 of each of an equivalent pair of grip components 5 with teeth 9 extending medially therefrom as seen in FIG. 9 and each grip component 5 is affixed to stabilizing strut 1 and in turn to one side of a ladder unit A by way of one of a pair of three sided dual bolt components 6 with threaded ends. The two threaded ends of dual bolt components 6, each bolt component 6 being equivalent to one air, fit through collinearly aligned through holes 11 in each grip component 5 for receipt of each threaded end by a turning nut 7 behind each of which can be found a washer unit 10. FIGS. 5 and 7 demonstrate such assembly of the invention to a ladder unit A. Moreover, as can be noted with resort to the drawings as a whole, the invention can be readily assembled to either side of a ladder unit A, a feature that sets the invention distinctly apart from any other variant forms of related art within the field of the invention. Footing component 2 as seen in FIGS. 1, 2,.9, 10, 11, 12, 13 through 15 extends laterally outward form an up and down imaginary extension of the plane of stabilizing strut 1. Moreover, as can be noted especially with resort to FIGS. 13 and 15, footing component 2 moreover flares symmetrically outwardly both anteriorly and posteriorly as noted above in order to provide spacing to accommodate a fit of the footing of one side of a ladder unit A whenever it is sought to utilize the invention to effectively elongate one side of a ladder unit A located over lateral sloping ground B. Spacing equivalent in breadth to at least, the spacing seen as between the interior side C of the footing of a ladder unit A as seen in FIG. 12 and the interior or medial side 2A of footing component 2 extends downwardly from the site near the bottom of that portion of stabilizing strut 1 all in one up and down plane in apposition to a side of ladder unit A where stabilizing strut 1 is conjoined to footing component 2 in order to provide clearance room, if need be, for the footing of one side of ladder A in ultimate apposition to foot unit 3 whenever the invention is fully assembled anywhere sufficiently low enough to that side of ladder unit A to give rise to any such practical clearance requirement from a vantage point of right functioning. Inner walling 2A of footing component 2 is shown in FIGS. 14 and 15 serving to evidence the fact of such clearance. Outer walling 2B of footing component 2 is seen in FIGS. 13 and 14. Anterior walling 2D and posterior walling 2E of footing component 2 is shown in FIGS. 13, 14 and 15. In FIGS. 9 and 10, anterior walling 2D is also depicted with particularity. And, in FIGS. 11 and 12, with anterior walling 2D cut away, posterior walling 2E is depicted with peculiarity. X units of distance separate outer walling 2B from the lateral edging of anterior walling 2D as seen in FIG. 14 and the lateral edging of posterior walling 2E. Y units of distance separate inner walling 2A from the medial edging of anterior walling 2D as seen in FIG. 14 and the email edge of posterior walling 2E. Foot unit 3 attached to footing component 2 as shown in FIG. 14 is anteroposteriorly pivotable about pivot point 2C as evidenced in FIGS. 13 and 15. Base stabilizing pod 4, which is attached to the bottom of foot unit 3, as seen in FIGS. 1, 2, 13, 13 and 15 is typically rubberized for purposes of providing traction upon ground B and serves to moreover more firmly hold an effectively elongated side of ladder unit A by virtue of attachment thereto of the assembled invention, firmly in place.

In conclusion, respectfully submitted, the foregoing recitations serve to evidence why the invention is indeed not only new and unique but unquestionably useful as well.

What is claimed is:

1. An extension ladder and leveling apparatus, said leveling apparatus comprising:

a. an elongated stabilizing strut affixed to one leg of said extension ladder;

b. a laterally extending footing component affixed to a base of said stabilizing strut;

c. said footing component being symmetrically flared outwardly both anteriorly and posteriorly from a locus of a vertically inclined central axis of symmetry of said stabilizing strut;

d. an anteroposteriorly pivotable foot unit attached to said footing component near a base of said footing component;

e. a rubberized base stabilizing pod attached to said foot unit at a base of said foot unit;

f. a series of evenly spaced teeth in a lateral side of said stabilizing strut extending from near a top side of said stabilizing strut to near said base of said stabilizing strut;

g. a pair of equivalent grip components, each with a series of evenly spaced teeth in a medial side thereof;

h. a pair of collinear through holes in each of said pair of equivalent grip components;

i. a pair of identical u-shaped dual bolt components with threaded ends with one of each said threaded ends being receivable by one of said collinear through holes in each one of said pair of equivalent grip components, and;

j. two pairs of identical threaded turning nuts each being affixable to one said threaded end of each of said dual bolt components.

2. The extension ladder with ladder leveling apparatus of claim 1, whereby, four identical washer units are available to fit one each over one of said threaded ends of each of said pair of identical three-sided dual bolt components in front of one of each of said pairs of identical threaded turning nuts.

* * * * *